US009772078B2

(12) United States Patent
Suggs

(10) Patent No.: US 9,772,078 B2
(45) Date of Patent: Sep. 26, 2017

(54) LIGHTED TOILET PAPER HOLDER

(71) Applicant: Timothy Suggs, Broadway, NC (US)

(72) Inventor: Timothy Suggs, Broadway, NC (US)

( * ) Notice: Subject to any disclaimer, the term of this patent is extended or adjusted under 35 U.S.C. 154(b) by 224 days.

(21) Appl. No.: 14/837,358

(22) Filed: Aug. 27, 2015

(65) Prior Publication Data

US 2017/0059104 A1 Mar. 2, 2017

(51) Int. Cl.

| | |
|---|---|
| ***F21S 9/02*** | (2006.01) |
| ***F21V 23/04*** | (2006.01) |
| ***A47K 10/32*** | (2006.01) |
| ***F21V 33/00*** | (2006.01) |

(52) U.S. Cl.

CPC ..... *F21S 9/02* (2013.01); *A47K 10/32* (2013.01); *F21V 23/04* (2013.01); *F21V 33/004* (2013.01)

(58) Field of Classification Search

CPC ..... F21S 9/02; F21V 33/004; F21V 23/04
See application file for complete search history.

(56) References Cited

U.S. PATENT DOCUMENTS

| | | | | |
|---|---|---|---|---|
| 5,624,025 | A | 4/1997 | Hixon | |
| D419,012 | S | 1/2000 | Wiggins, Jr. | |
| 6,065,852 | A | 5/2000 | Crumley | |
| 6,628,789 | B1 * | 9/2003 | Colby | A47K 10/38 242/599 |
| 6,688,551 | B1 * | 2/2004 | He | A47K 10/40 239/52 |
| 6,758,584 | B2 | 7/2004 | Bach et al. | |
| 7,416,153 | B1 * | 8/2008 | Dervin | A47K 10/40 242/599.1 |
| 8,206,003 | B1 | 6/2012 | LaBarge | |
| 8,533,912 | B2 | 9/2013 | Tran | |
| 2008/0184475 | A1 | 8/2008 | Sladick et al. | |
| 2008/0266844 | A1 | 10/2008 | Reynolds et al. | |
| 2012/0138654 | A1 | 6/2012 | Lee | |
| 2013/0056489 | A1 * | 3/2013 | Palamountain | A47K 10/32 221/59 |
| 2014/0076508 | A1 * | 3/2014 | Mullet | E06B 9/72 160/310 |

* cited by examiner

*Primary Examiner* — Elmito Breval

(74) *Attorney, Agent, or Firm* — Coats & Bennett, PLLC

(57) ABSTRACT

A toilet paper holder that is lighted to provide illumination in a darkened environment. The holder includes an elongated tube sized to fit within the interior of a roll of toilet paper. A light source and a battery are each mounted within the interior of the tube. The light source is configured to emit light to illuminate the interior of the tube. The tube is constructed such that at least a portion of the light is emitted from the tube to illuminate the surrounding exterior area.

19 Claims, 3 Drawing Sheets

LIGHTED TOILET PAPER HOLDER

FIELD OF THE INVENTION

The present application is directed to a light for use in a bathroom and, more particularly, to a lighted toilet paper holder.

BACKGROUND

Many people like to have a light on at night while they are sleeping. The light allows them to see if they were to wake up in the middle of the night. The light may also orient the person when they awake, and may also provide illumination to allow the person to get out of bed and navigate their surroundings.

It is often necessary for people to use the bathroom at night. It is often difficult for a person to walk at night from their bed to the bathroom due to the darkened environment. Further, the bathroom is often exceptionally dark at night as the room may not include any windows or other light source. Further, bathrooms often small and not conducive for a light.

A light at night should provide a person with the ability to see their surroundings, but not be too bright as to be a nuisance. Further, an overly-bright light may keep a person awake at night and not allow them to have adequate sleep.

SUMMARY

The present application is directed to a device for holding a roll of toilet paper. The device can be illuminated to provide for a light source in a darkened environment.

One embodiment is directed to a toilet paper device for holding a roll of toilet paper. The device includes an elongated tube with a first section and a second section that are telescopingly engaged together and form an interior space. The tube includes an overlapping section where the first and second sections overlap, a first section on a first lateral side of the overlapping section, and an opposing second section on a second side of the overlapping section. The device also includes a battery positioned within the interior space at the overlapping section. The device includes a switch with a knob that extends through an opening in one of the first and second sections and with the switch being operatively connected to the battery. A light source is positioned within the interior space and includes a first light positioned between the battery and a first end of the first section with the first light facing towards the first end to illuminate the first section of the tube. The light source also includes a second light positioned between the battery and a second end of the second section with the second light facing towards the second end to illuminate the second section of the tube. The first and second lights face away from the battery such that the overlapping section is not illuminated.

The overlapping section may be centered along a longitudinal length of the tube.

The device may also include a spring positioned within the interior space and that contacts against each of the first and second sections to bias the first and second sections apart.

The tube may be translucent.

The device may also include a first light reflector in the interior space of the tube at the first end of the first section and a second light reflector in the interior space of the tube at the second end of the second section.

A central section of the tube may be opaque.

The first section of the tube may extend into an interior of the second section of the tube and the battery with the switch and the light source being mounted in the first section.

Each of the first and second ends may be closed.

Another embodiment is directed to a toilet paper device for holding a roll of toilet paper. The device includes an elongated tube with separate first and second sections that are inserted together with an inner end of the first section positioned within an inner end of the second section. The tube includes opposing first and second outer ends and sidewalls that form an interior space and with the tube having a longitudinal length measured between the first and second outer ends and including a central section where the sidewalls of the first and second sections overlap. The tube also includes a first end section between central section and the first end, and a second end section between the central section and the second end. A battery is positioned within the interior space at the central section and is attached to the sidewall of the first section. A light source is positioned within the interior space and is attached to the sidewall of the first section. The light source includes a first light positioned on a first lateral side of the battery to illuminate the first end section and a second light positioned on an opposing second lateral side of the battery to illuminate the second end section.

The first and second lights may face away from the central section of the tube.

The device may also include reflectors positioned at the outer ends of the tube to reflect light that is emitted from the first and second lights.

The device may also include opaque members positioned at the outer ends of the tube to prevent light from being emitted from the outer ends of the tube.

The device may include an opening in the sidewall of the first section and a switch positioned in the opening that is operatively connected to the light source.

The device may include a spring that contacts against each of the first and second sections and that extends around the battery and the light source with the spring configured to bias the first and second sections apart.

The tube may be translucent.

The device may also include a switch with a knob that extends through an opening in the first section and a lead that is connected to the battery.

Another embodiment is directed to a toilet paper device for holding a roll of toilet paper. The device includes a tube with inner and outer sections mounted together with the inner section partially positioned within the outer section. The outer section includes a larger cross-sectional size to be movable along an exterior of the inner section. The tube includes an overlapping longitudinal section where the inner section is positioned within and overlaps with the outer section. A battery is positioned within the tube and is connected to the inner section along the overlapping section. The device also includes a switch with a knob that extends through an opening in the inner section with the switch being operatively connected to the battery. A light source is positioned within the interior space and is connected to the inner section. The light source includes a first light positioned on a first side of the battery and a second light positioned on a second side of the battery. The first and second lights face away from the battery and are positioned such that the overlapping section of the tube at the battery is not illuminated.

The first and second lights may be positioned such that an entirety of the overlapping section of the tube is not illuminated.

The inner and outer sections may be translucent.

The various aspects of the various embodiments may be used alone or in any combination, as is desired.

DETAILED DESCRIPTION

Figure 1:
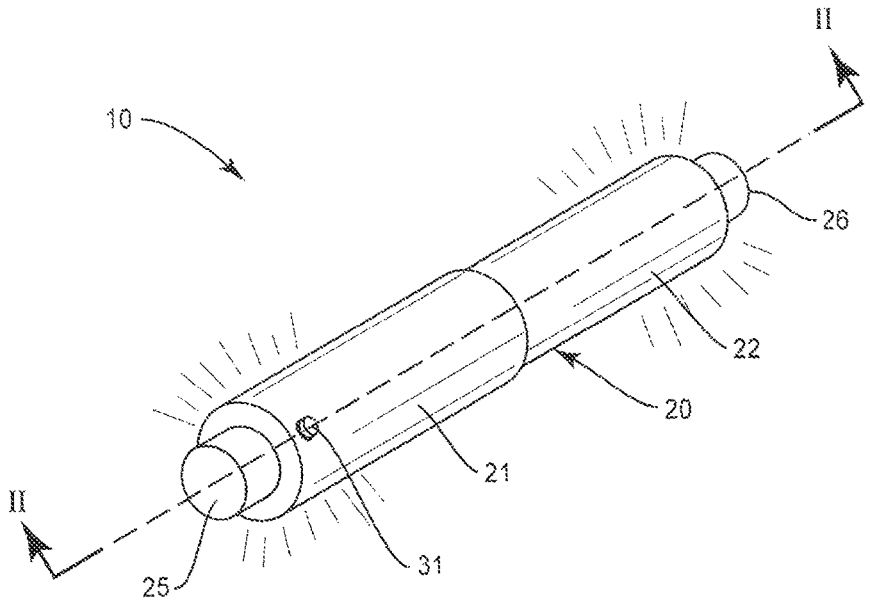
FIG. 1 is a perspective view of a lighted toilet paper holder.

The present application is directed to a lighted toilet paper holder 10. The holder 10 includes an elongated tube 20 sized to fit within the interior of a roll of toilet paper. A light source 30 and a battery 40 are each mounted within the interior of the tube 20. The light source 30 is configured to emit light to illuminate the interior of the tube 20. The tube 20 is constructed such that at least a portion of the light is emitted from the tube 20 to illuminate the surrounding exterior area.

The tube 20 includes an elongated shape sized to extend through the interior of a roll of toilet paper. The tube 20 includes opposing ends 25, 26 that are sized to engage with mounts to secure the tube 20. In one common embodiment, the mounts are secured to a wall of a bathroom and spaced apart a distance that is spanned by the tube 20. The toilet paper roll fits between the mounts and around the tube 20.

Figure 2:
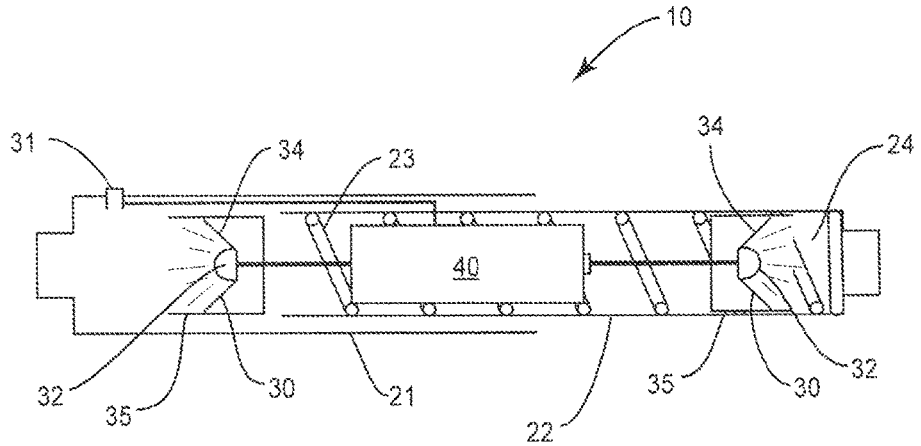
FIG. 2 is a sectional view of the lighted toilet paper holder cut along line II-II of FIG. 1.

As illustrated in FIGS. 1 and 2, the tube 20 is constructed from first and second sections 21, 22. Each section 21, 22 includes a substantially cylindrical shape with an outer end and an inner end. The inner ends of each section 21, 22 are open. The outer ends may be open, partially open, or closed. Each section 21, 22 includes sidewalls that extend between the inner and outer ends. The sections 21, 22 overlap and are positioned to form an interior space 25.

The sections 21, 22 are positioned in a telescoping arrangement with an open end of the second section 22 extending through the open end and into the interior of the first section 21. The second section 22 has a smaller cross-sectional size and is able to fit within the open end and interior of the first section 21. The amount of overlap between the sections 21, 22 may vary. A spring 23 is positioned within the interior of the tube 20 and biases apart the first and second sections 21, 22. As illustrated in FIG. 2, the spring 23 includes a first end that contacts an end wall of the second section 22 and a second end that contacts against an end wall of the first section 21. In another embodiment, the spring 23 may extend less than an entire distance between the end walls. A flange or other structure may extend inward from a side wall of one or both sections 21, 22 to secure the spring 23.

The sections 21, 22 may include lips that contact together to control an extent of elongation and keep the sections 21, 22 connected together. During relative movement between the sections 21, 22, the outer section (e.g., section 21 in FIGS. 1 and 2) slides along the exterior of the inner section. In one embodiment, each of the sections 21, 22 includes a circular cross-sectional shape to facilitate the sliding movement.

Each of the sections 21, 22 may include the same longitudinal length measured between the inner and outer ends. With each of the sections 21, 22 having the same length, the area of overlap of the sections 21, 22 is along a central portion of the tube 20. Alternatively, one of the sections 21, 22 may include a greater longitudinal length. When one of the sections 21, 22 includes a greater length, the overlap is positioned in closer proximity to one of the ends 25, 26 of the tube 20.

Figure 3:
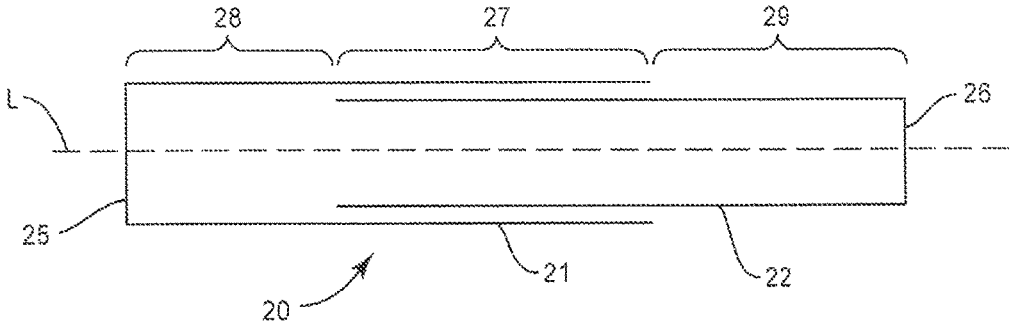
FIG. 3 is a schematic side view of a tube having an elongated shape with an overlapping section, first outer section, and a second outer section.

FIG. 3 illustrates a side schematic view of the tube 20 with an elongated shape having a longitudinal axis L that extends through each of the ends 25, 26. The ends 25, 26 may be open, may be closed (as illustrated in FIG. 3), or may be partially closed (e.g., include small openings). The configurations of the ends 25, 26 may be the same or may be different.

The tube 20 includes an overlapping section 27. In FIG. 3, this overlapping section 27 is centered at a longitudinal center of the tube 20. The length of the overlapping section 27 may vary. The tube 20 also includes a first longitudinal section 28 extends between the first end 25 and the overlapping section 27. A second longitudinal section 29 extends between the second end 26 and the overlapping section 27. The first and second sections 28, 29 may include the same longitudinal lengths, such as may occur when the lengths of the first and second sections 21, 22 is equal. The sections 28, 29 may also include different longitudinal lengths. The size of the overlapping section 27 may vary when the tube 20 is compressed by the user and/or when the tube 20 is positioned within the mounts 100.

The tube 20 is constructed for light emitted from the light source 30 that is positioned within the interior 24 to illuminate the surrounding space. The sections 21, 22 may be transparent or translucent such that the exterior area around the tube 20 is lighted by the light source 30. Each of the sections 21, 22 may be constructed in the same manner such that light is equally emitted through each section 21, 22. The sections 21, 22 may include different constructions such that more light is emitted to the exterior through one of the sections 21, 22 than the other section 21, 22. The sections 21, 22 may be constructed from a variety of different materials that allows for light to illuminate the surrounding exterior area. Examples include but are not limited to plastic, polyvinyl chloride, glass, acrylic, and various polymers.

One or both of the ends 25, 26 may be open such that the light passes outward to the surrounding exterior area. This may include the entire end 25, 26 or a limited portion of the ends 25, 26 being open to allow the passage of the light. In one embodiment in which one or both ends 25, 26 are open, the sidewalls of the sections 21, 22 are opaque. Therefore, the only light emitted from the tube 20 is through the ends 25, 26.

Reflectors 61 may be positioned in the interior space 24 at one or both of the ends 25, 26. The reflectors 61 reflect light that is passing towards the ends 25, 26 and redirects the light towards the sidewalls of the tube 20. This reflection of light causes a brighter illumination of the tube 20 and thus a brighter illumination of the surrounding exterior area.

The battery 40 is positioned within the interior space 24 and provides power to the light source 30. In one embodiment, the battery 40 is positioned along the overlapping section 27 of the tube 20. The battery 40 may include a single component (e.g., a single size AA disposable battery) or may include multiple components (e.g., two AA disposable batteries). The battery 40 may be rechargeable or may be non-rechargeable.

Figure 4:
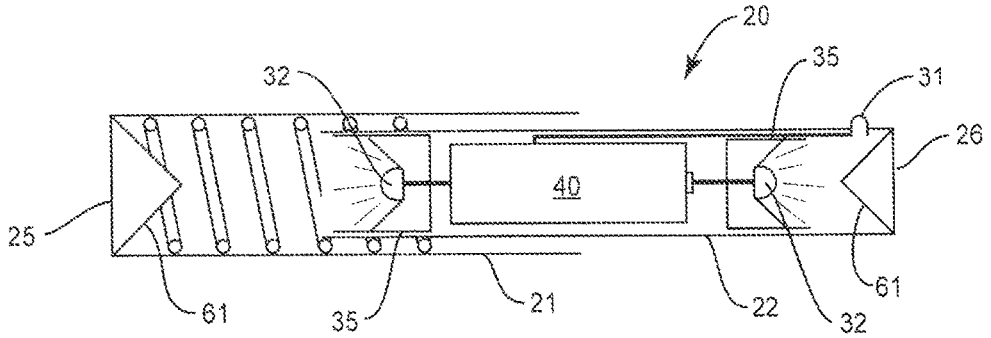
FIG. 4 is a schematic sectional view illustrating a battery and a light source within an interior of a tube.
Figure 5:
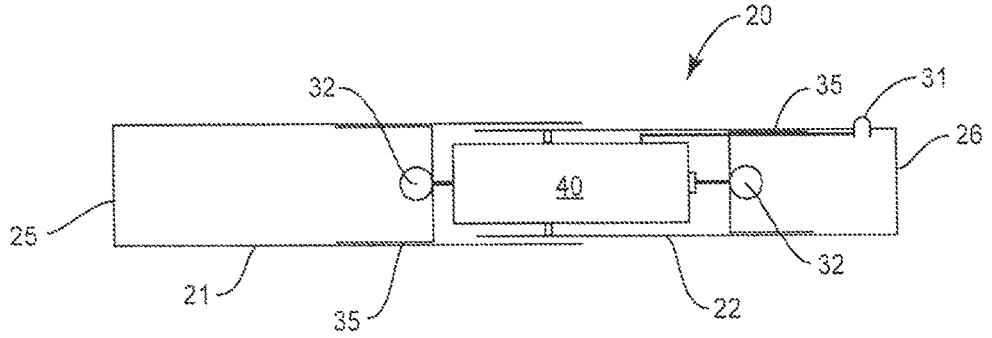
FIG. 5 is a schematic sectional view illustrating a battery and a light source within an interior of a tube.

The battery 40 is positioned in the interior 24 of the tube 20. The battery 40 may be attached to the inner edges of the sidewalls of one or both of the sections 21, 22. This attachment prevents the battery 40 from moving within the interior space 24 when the holder 10 is in use. In one embodiment as illustrated in FIG. 4, the battery 40 is mounted to the interior of the sidewalls of the second section 22. This positioning within the smaller inner section 22 permits telescoping movement between the sections 21, 22 without the battery 40 interfering with the sliding movement of the outer section 21. FIG. 5 includes the battery 40 connected to both of the sections 21, 22. In this embodiment, the connection to the outer section 21 does not prevent telescoping movement. In one specific embodiment, this is accomplished by the connection to the outer section 21 being distanced from the inner section 22 thus allowing for the desired amount of relative movement between the sections 21, 22.

The light source 40 includes one or more light-emitting elements that illuminate a portion of the interior space 24. In one embodiment, the light source 40 includes first and second bulbs 32. The bulbs 32 are positioned to illuminate different portions of the interior space 24. As illustrated in FIG. 2, the first bulb 32 may illuminate the interior space 24 on one side of the battery 40 and the second bulb 32 illuminates the opposing second side of the battery 40. This may include the first bulb 32 illuminating the first section 28 (see FIG. 3) that extends between the battery 40 and the first end 25, and the second bulb 32 illuminating the second section 29 between the battery 40 and the second end 26.

The bulbs 32 may each be positioned in a mount 35 that secures to the inner edges of the sidewalls. The mounts 35 include a frame that protects the bulbs 32 and provides for securing the bulbs 32 in the interior space 24. The mounts 35 may include exterior threads that threadingly engage corresponding threads on the interior sidewalls of the sections 21, 22. The mounts 35 may also be secured through a friction fit against the interior sidewalls. Securement may also be obtained by one or more mechanical fasteners.

The mounts 35 may include a reflective surface to direct the light emitted from the bulbs 32 outward into the interior space 24. Further, a separate reflector 34 may be positioned behind each of the bulbs 32.

The light source 30 is mounted in the interior 24 of the tube 20. FIG. 4 includes the light source 30 mounted to the inner edges of the sidewall of the inner section (i.e., section 22). This positioning prevents the light source 30 from interfering with the relative movement of the first and second sections 21, 22 during the telescoping movement. FIG. 5 includes one of the mounts 35 and bulbs 32 mounted to the inner section 22 and the second mount 35 and bulb 32 mounted to the outer section 21. The mount 35 mounted to the outer section 21 is positioned to prevent interference with the telescoping movement.

A switch 31 is positioned on the exterior of the tube 20 for selectively powering the light source 30. The switch 31 is positioned and configured to be accessible on the exterior of the tube 20 for a user to access and control the light source 30. The holder 10 may include a single switch 31 or may include multiple switches 31.

Figure 6:
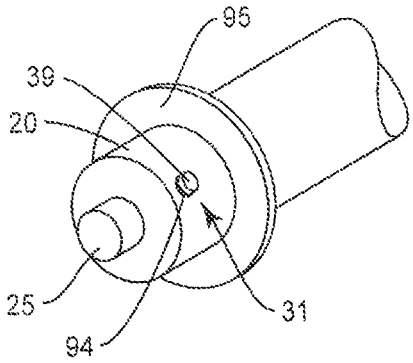
FIG. 6 is a partial perspective view of a knob positioned at an end of the tube.

FIG. 6 illustrates a switch 31 that includes a knob 39 that extends through an opening 94 in the tube 20. The switch 31 includes one or more leads that are operatively connected to the light source 30. Movement of the knob 39 activates the light source 30. In one embodiment, a single knob 39 controls the activation of two bulbs 32. Depressing the knob 39 a first time activates just the first bulb 32, a second time activates just the second bulb 32, and a third time activates both bulbs 33. Depressing the knob 39 an additional fourth time deactivates both bulbs 32. In this manner, the user may control the desired amount of light being emitted from the holder 10.

Figure 8:
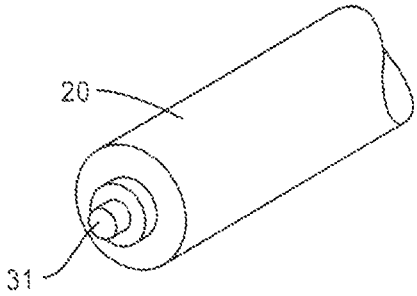
FIG. 8 is a partial perspective view of a knob of a switch positioned at an end of a tube.

In one embodiment as illustrated in FIG. 8, the switch 31 is positioned at the end of the one of the tube sections 21, 22 (FIG. 8 includes the switch 31 at the end of the second section 22).

The switch 31 may extend outward from the tube 20. This provides for a user to tactilely feel the switch 31 and apply a force to depress it. In another embodiment, the switch 31 is positioned to be flush with the tube 20 or recessed below the surface of the tube 20. This may protect the switch 31 and prevent it from being inadvertently depressed by the toilet paper roll 110.

The knob 39 is positioned in proximity to the end 25 of the tube 20. This allows for the knob 39 to be accessible to the user when a roll of toilet paper is positioned on the tube 20. As illustrated in FIG. 6, a flange 95 may radially extend outward from the tube 20 between the knob 39 and a center of the tube 20 where the toilet paper roll is mounted. This flange 95 is sized to prevent the roll from migrating over the knob 39 and blocking its access from a user. The flange 95 may extend around the circumference of the tube 20, or may extend around a limited portion of the circumference.

In one embodiment, the battery 40 and light source 30 are mounted to the smaller second section 22. Further, the switch 31 is also positioned in the second section 22. This provides for no relative movement between the battery, light source 30 and the switch 30. Thus, a wire lead that extends from the switch 31 to the battery 40 does not become twisted or otherwise separated and remains functional. The battery 40 and light source 30 may be connected together as part of a unit that is mounted to the second section 22. The unit is fixedly mounted to the inner sidewalls of the second section 22.

Figure 7:
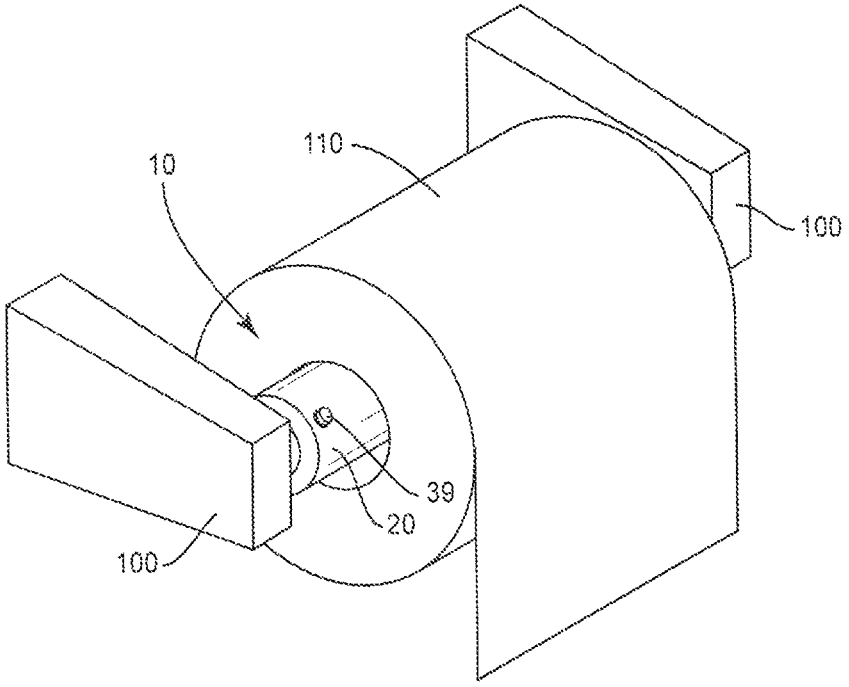
FIG. 7 is a perspective view of a toilet paper holder positioned within an interior of a toilet paper roll and positioned in mounts.

In use, a user inserts the tube 20 through the interior of a roll of toilet paper 110 as illustrated in FIG. 7. The user than telescopingly collapses the sections 21, 22 reducing the overall length of the tube 20 and positions the reduced tube 20 between mounts 100. Once positioned, the user removes the force from the sections 21, 22 allowing the tube 20 to elongated and seat in the mounts 100. The user then depresses the knob 39 to activate the light source 30. As illustrated in FIG. 7, the knob 39 is positioned in proximity to one of the ends of the tube 20 such that it is accessible between the mount 100 and the roll 110. The user is able to select the amount of light that is illuminates the surrounding area.

The holder 10 is designed such that just the outer longitudinal portions of the tube 20 are illuminated. In one embodiment, this includes the first section 21 between the battery 40 and the first end 25, and the second section 22 between the battery and the second end 26. By not illuminating the entire length of the tube 20, battery power is conserved. Likewise, a user is able to power just a limited number of the bulbs 32 in a multi-bulb embodiment to again save battery power.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toilet paper device for holding a roll of toilet paper, the device comprising:

an elongated tube comprising a first section and a second section telescopingly engaged together and forming an interior space, the tube comprising an overlapping section where the first and second sections overlap, the tube comprising a first section on a first lateral side of the overlapping section, and an opposing second section on a second side of the overlapping section;

a battery positioned within the interior space at the overlapping section;

a switch with a knob that extends through an opening in one of the first and second sections, the switch being operatively connected to the battery;

a light source positioned within the interior space and comprising a first light positioned between the battery and a first end of the first section, the first light facing towards the first end to illuminate the first section of the tube, the light source also comprising a second light positioned between the battery and a second end of the second section, the second light facing towards the second end to illuminate the second section of the tube;

the first and second lights facing away from the battery such that the overlapping section is not illuminated.

2. The toilet paper device of claim 1, wherein the overlapping section is centered along a longitudinal length of the tube.

3. The toilet paper device of claim 1, further comprising a spring positioned within the interior space and that contacts against each of the first and second sections to bias the first and second sections apart.

4. The toilet paper device of claim 1, wherein the tube is translucent.

5. The toilet paper device of claim 1 further comprising a first light reflector in the interior space of the tube at the first end of the first section and a second light reflector in the interior space of the tube at the second end of the second section.

6. The toilet paper device of claim 1, wherein a central section of the tube is opaque.

7. The toilet paper device of claim 1, wherein the first section of the tube extends into an interior of the second section of the tube and the battery, the switch, and the light source are mounted in the first section.

8. The toilet paper device of claim 1, wherein each of the first and second ends are closed.

9. A toilet paper device for holding a roll of toilet paper, the device comprising:

an elongated tube comprising separate first and second sections that are inserted together with an inner end of the first section positioned within an inner end of the second section, the tube including opposing first and second outer ends and sidewalls that form an interior space, the tube having a longitudinal length measured between the first and second outer ends and including a central section where the sidewalls of the first and second sections overlap, a first end section between central section and the first end, and a second end section between the central section and the second end;

a battery positioned within the interior space at the central section and attached to the sidewall of the first section;

a light source positioned within the interior space and attached to the sidewall of the first section, the light source comprising a first light positioned on a first lateral side of the battery to illuminate the first end section and a second light positioned on an opposing second lateral side of the battery to illuminate the second end section.

10. The toilet paper device of claim 9, wherein the first and second lights face away from the central section of the tube.

11. The toilet paper device of claim 9, further comprising reflectors positioned at the outer ends of the tube to reflect light that is emitted from the first and second lights.

12. The toilet paper device of claim 9, wherein the tube is transparent.

13. The toilet paper device of claim 9, further comprising an opening in the sidewall of the first section and a switch positioned in the opening that is operatively connected to the light source.

14. The toilet paper device of claim 9, further comprising a spring that contacts against each of the first and second sections and that extends around the battery and the light source, the spring configured to bias the first and second sections apart.

15. The toilet paper device of claim 9, wherein the tube is translucent.

16. The toilet paper device of claim 9, further comprising a switch comprising a knob that extends through an opening in the first section and a lead that is connected to the battery.

17. A toilet paper device for holding a roll of toilet paper, the device comprising:

a tube comprising inner and outer sections mounted together with the inner section partially positioned within the outer section, the outer section including a larger cross-sectional size to be movable along an exterior of the inner section, the tube including an overlapping longitudinal section where the inner section is positioned within and overlaps with the outer section;

a battery positioned within the tube and connected to the inner section along the overlapping section;

a switch with a knob that extends through an opening in the inner section, the switch being operatively connected to the battery;

a light source positioned within the interior space and connected to the inner section, the light source comprising a first light positioned on a first side of the battery and a second light positioned on a second side of the battery;

the first and second lights facing away from the battery and positioned such that the overlapping section of the tube at the battery is not illuminated.

18. The device of claim 17, wherein the first and second lights are positioned such that an entirety of the overlapping section of the tube is not illuminated.

19. The device of claim 17, wherein the inner and outer sections are translucent.

* * * * *